US010168100B2

(12) United States Patent
Smith

(10) Patent No.: US 10,168,100 B2
(45) Date of Patent: Jan. 1, 2019

(54) FURNACE STAVE

(71) Applicant: Berry Metal Company, Harmony, PA (US)

(72) Inventor: Todd G. Smith, Grove City, PA (US)

(73) Assignee: Berry Metal Company, Harmony, PA (US)

( * ) Notice: Subject to any disclaimer, the term of this patent is extended or adjusted under 35 U.S.C. 154(b) by 0 days.

(21) Appl. No.: 14/964,126

(22) Filed: Dec. 9, 2015

(65) Prior Publication Data

US 2016/0161185 A1 Jun. 9, 2016

Related U.S. Application Data

(60) Provisional application No. 62/089,503, filed on Dec. 9, 2014.

(51) Int. Cl.

| | |
|---|---|
| ***F27D 1/12*** | (2006.01) |
| ***C21B 7/10*** | (2006.01) |
| ***F27B 1/24*** | (2006.01) |
| *F27D 9/00* | (2006.01) |

(52) U.S. Cl.

CPC ..... *F27D 1/12* (2013.01); *C21B 7/10* (2013.01); *F27B 1/24* (2013.01); *F27D 2009/0045* (2013.01); *F27D 2009/0048* (2013.01); *F27D 2009/0051* (2013.01)

(58) Field of Classification Search

CPC ..... F27D 1/12
USPC ..... 266/193
See application file for complete search history.

(56) References Cited

U.S. PATENT DOCUMENTS

2016/0161185 A1* 6/2016 Smith ..... F27D 1/12
266/193

FOREIGN PATENT DOCUMENTS

DE 10211248 A1 * 9/2003 ..... F27B 7/161
EP 0029416 A1 * 5/1981 ..... F27B 3/24

* cited by examiner

*Primary Examiner* — Scott Kastler
(74) *Attorney, Agent, or Firm* — Clark Hill PLC

(57) ABSTRACT

A furnace stave comprising a plurality of internal channels or conduits for circulating cooling fluid through the stave; an inlet and an outlet channel associated with each internal channel; wherein the inlet channels of two internal channels are fed by the same inlet pipe or conduit. In another preferred aspect, the inlet channels of two internal channels fed by the same inlet pipe or conduit may or may not be overlapping or in fluid communication with each other.

2 Claims, 2 Drawing Sheets

SECTION A-A

SECTION B-B

SECTION C-C

FURNACE STAVE

CROSS REFERENCE TO RELATED APPLICATIONS

This application claims the benefit of provisional patent application U.S. Ser. No. 62/089,503 filed Dec. 9, 2014, entitled Furnace Stave which is incorporated by reference herein for all purposes.

TECHNICAL FIELD

The present disclosure generally relates to the field of cooling equipment for metallurgical furnaces such as blast furnaces. More precisely, the present disclosure concerns a stave cooler. Related fields include systems and methods for cooling blast furnaces and other metallurgical furnaces. Related fields include cooling plates and cooling staves.

BACKGROUND

Field of the Disclosure

Conventional designs and constructions for cooling refractory bricks in blast furnaces and other metallurgical furnaces include cooling staves. Conventional copper cooling staves are generally planar, rectangularly shaped and arranged within a furnace substantially parallel or as parallel as possible, given the shapes of the staves and/or the interior of the furnace, to the metal shell of the furnace. The cooling staves typically cover a high percentage of the inner surface of the metal shell of the furnace. Refractory lining, such as refractory bricks, may be disposed in, on or around the surface of the stave, such as, for example, bricks disposed within slots or channels defined by the stave. Staves also have cavities that provide passages or house internal piping. Such passages or piping are connected to one or more external pipes that extend from the furnace shell side of the stave and penetrate the metal shell of the furnace. Coolant, such as, for example, water at an elevated pressure is pumped through the pipes and/or passages in order to cool the stave. The cooled stave thus cools the refractory bricks disposed within slots or channels defined by the stave.

FIG. 1 illustrates a planar, fluid cooled stave 10 of known construction having a plurality of stave ribs 11 and defining a plurality of stave channels 12, both of generally rectangular cross-sections for use with bricks having matching cross-sections. As shown in FIG. 1, stave 10 comprises a plurality of channels or pipes 14 disposed inside the stave 10 which may be connected to one or more external pipes 13 that extend from the furnace shell side of the stave 10 and penetrate the metal shell of the furnace so that coolant, such as, for example, water at an elevated pressure is pumped through the pipes 13 and channels 14 in order to cool the stave 10 and any refractory bricks disposed within stave channels 12 when assembled and installed in a furnace.

Conventional cooling staves or plates 10 typically have one external pipe 13 per internal pipe or channel 14 for this purpose. The stave 10 may be made from a forged or rolled copper slab. The coolant channels 14 typically are blind holes introduced by deep drilling the rolled copper slab. The blind bores are sealed off by welding in plugs. Then, connecting bores to the blind bores (typically one connecting bore per blind bore) are drilled from the rear side of the plate body. Thereafter, the ends of connection pipes 13 for the coolant feed or coolant return are inserted into these connecting bores and welded to the stave body. Due to considerable mechanical and thermal stress to which the stave cooler is exposed, the different welded connection joints are critical as regards fluid tightness. Thus, it would be beneficial to reduce the number of such weld connections necessary in a stave.

SUMMARY

In a preferred aspect, the present disclosure comprises a furnace stave comprising a plurality of internal channels or conduits for circulating cooling fluid through the stave; an inlet and an outlet channel associated with each internal channel; wherein the inlet channels of two internal channels are fed by the same inlet pipe or conduit.

In another preferred aspect, the inlet channels of two internal channels fed by the same inlet pipe or conduit may or may not be overlapping or in fluid communication with each other.

In yet another preferred aspect, the inlet channels of two internal channels fed by the same inlet pipe or conduit are in fluid communication with each other.

In another preferred aspect, the inlet channels of two internal channels fed by the same inlet pipe or conduit are not in fluid communication with each other.

In an additional preferred aspect, the two internal channels are two consecutive channels of the stave.

In another preferred aspect, the two internal channels are two non-consecutive channels of the stave.

In yet a further preferred aspect, the outlet channels of two internal channels feed the same outlet pipe or conduit and preferably one or more of the following may apply: (1) the outlet channels of two internal channels feeding the same outlet pipe or conduit may or may not be overlapping or in fluid communication with each other; (2) the outlet channels of two internal channels feeding the same outlet pipe or conduit are in fluid communication with each other; (3) the outlet channels of two internal channels feeding the same outlet pipe or conduit are not in fluid communication with each other; (4) the two internal channels are two consecutive channels of the stave; and/or (5) the two internal channels are two non-consecutive channels of the stave.

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION

In the following detailed description, reference is made to the accompanying examples and figures that form a part hereof, and in which is shown, by way of illustration, specific embodiments in which the disclosure may be practiced. These embodiments are described in sufficient detail to enable those skilled in the art to practice them, and it is to be understood that other embodiments may be utilized and that structural or logical changes may be made without departing from the scope of the disclosure. Such embodiments of the disclosure may be referred to, individually and/or collectively, herein by the term "disclosure" merely for convenience and without intending to voluntarily limit the scope of this application to any single concept, structure or method if more than one is in fact disclosed.

The following description is, therefore, not to be taken in a limited sense, and the scope of the present disclosure is defined by the appended claims and their equivalents.

Figure 3:
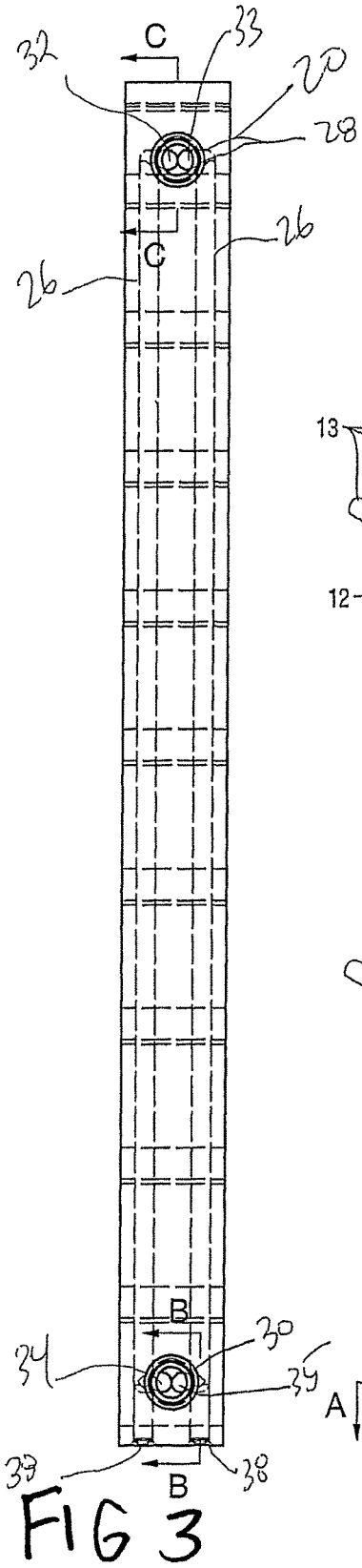
FIG. 3 is a partial rear view of a stave without inlet/outlet pipes attached according to a preferred embodiment of a stave according to the present disclosure.
Figure 1:
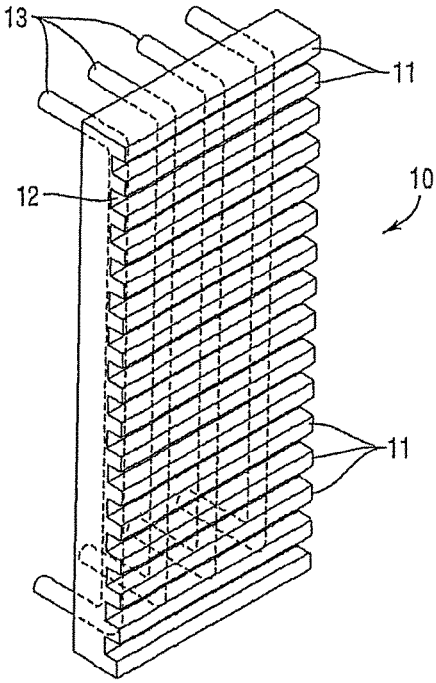
Prior Art Fig.1
FIG. 1 is a front perspective view of a conventional stave.
Figure 2:
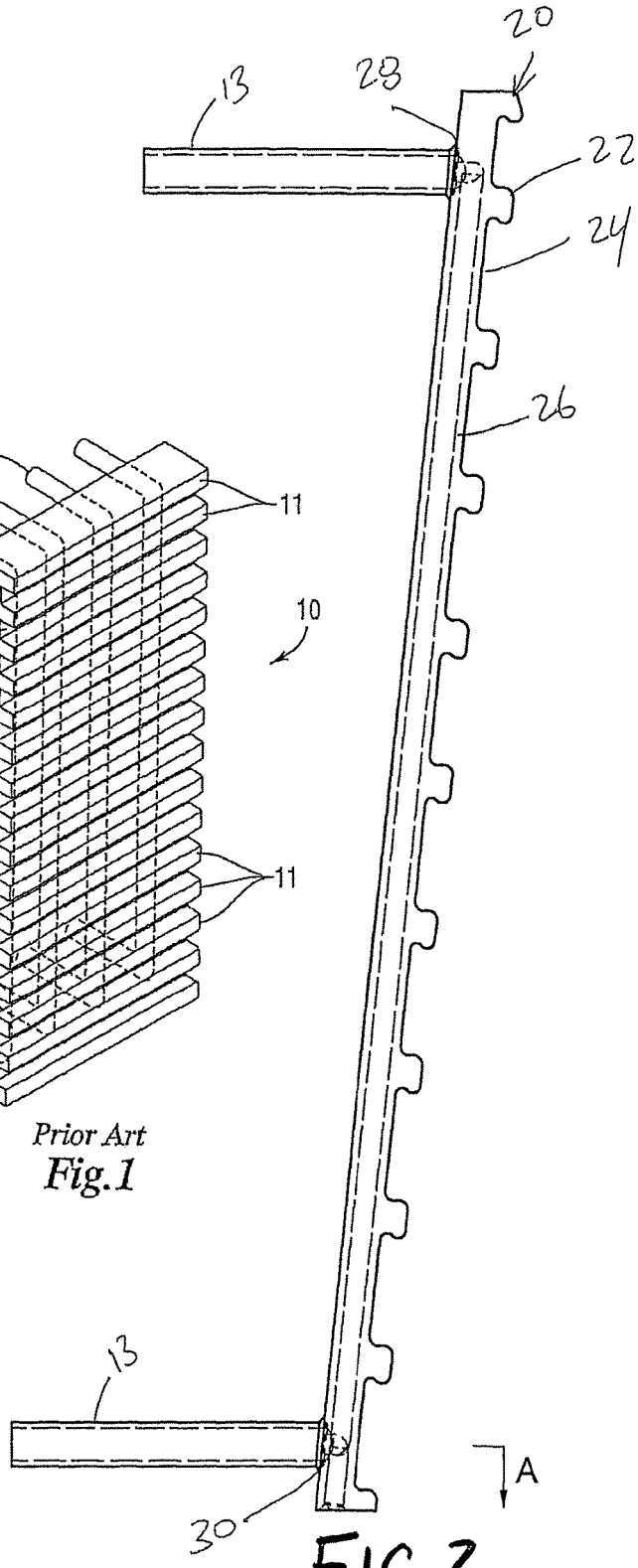
FIG. 2 is a side view of a stave according to a preferred embodiment of the present disclosure.
Figure 4:
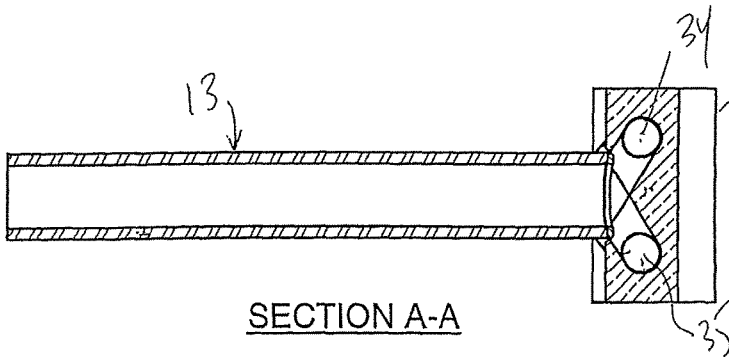
FIG. 4 is a cross-sectional view along Line A-A of FIG. 2.
Figure 5:
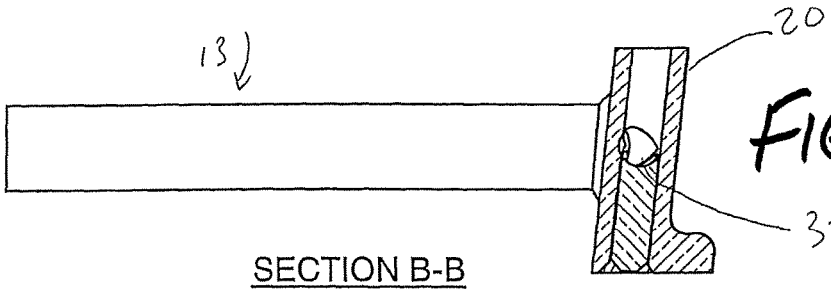
FIG. 5 is a cross-sectional view along Line B-B of FIG. 3.
Figure 6:
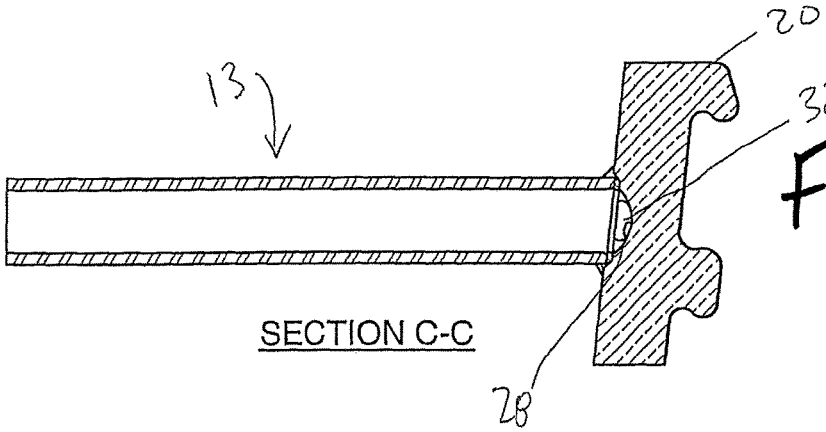
FIG. 6 is a cross-sectional view along Line C-C of FIG. 3.

FIGS. 2-6 illustrate a preferred embodiment of a planar, drilled/plugged fluid cooled stave 20 according to a preferred embodiment of the present disclosure. Stave 20 defines ribs 22 and channels 24 for receiving bricks (not shown). Stave 20 also preferably defines a plurality of channels 26 which preferably have been drilled into stave 20 for circulating cooling fluid such as water. The bottom of each channel 26 is preferably sealed by a plug 38 affixed by welding, brazing or as otherwise known in the art. Preferably, each inlet pipe 13 provides cooling fluid two channels 26 via two inlet channels 32, 33 which may or may not be overlapping or in fluid communication with each other as shown in FIGS. 3 and 6. Preferably, each outlet pipe 13 receives cooling fluid two channels 26 via two outlet channels 34, 35 which may or may not be overlapping or in fluid communication with each other as shown in FIGS. 3-5.

Preferably, stave 20 of the present disclosure allows for a stave having reduced weight requiring less copper or other materials and allows for small diameter channels 26 and a thinner stave overall.

In the foregoing Detailed Description, various features are grouped together in a single embodiment to streamline the disclosure. This method of disclosure is not to be interpreted as reflecting an intention that the claimed embodiments of the disclosure require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A furnace stave comprising a plurality of internal channels or conduits for circulating cooling fluid through the stave; wherein the stave comprises first and second opposite ends and each of the plurality of internal channels run between the first and second opposite ends;

a plurality of cooling fluid inlet conduits defined by the first end of the stave;

a plurality of cooling fluid outlet conduits defined by the second end of the stave;

a plurality of inlet channels, wherein each inlet channel is defined by the first end of the stave and is associated with one of the plurality of internal channels;

a plurality of outlet channels, wherein each outlet channel is defined by the second end of the stave and is associated with one of the plurality of internal channels;

wherein each cooling fluid inlet conduit only feeds the inlet channels of two non-consecutive internal channels.

2. The stave of claim 1 wherein each cooling fluid outlet conduit is fed only by the outlet channels of two non-consecutive internal channels.

* * * * *